US012485339B2

(12) United States Patent
Beaudet et al.

(10) Patent No.: US 12,485,339 B2
(45) Date of Patent: Dec. 2, 2025

(54) SKATE BLADE CLAMPING SYSTEMS

(71) Applicant: Velasa Sports, Inc., Acton, MA (US)

(72) Inventors: Daniel A. Beaudet, Lexington, MA (US); Russell K. Layton, Jr., Acton, MA (US)

(73) Assignee: Velasa Sports, Inc., Acton, MA (US)

( * ) Notice: Subject to any disclaimer, the term of this patent is extended or adjusted under 35 U.S.C. 154(b) by 53 days.

(21) Appl. No.: 18/486,531

(22) Filed: Oct. 13, 2023

(65) Prior Publication Data

US 2024/0123320 A1 Apr. 18, 2024

Related U.S. Application Data

(60) Provisional application No. 63/379,630, filed on Oct. 14, 2022.

(51) Int. Cl.
*A63C 1/32* (2006.01)
*A63C 3/10* (2006.01)

(52) U.S. Cl.
CPC . *A63C 1/32* (2013.01); *A63C 3/10* (2013.01)

(58) Field of Classification Search
CPC .. A63C 1/303; A63C 1/32; A63C 1/34; A63C 3/10
See application file for complete search history.

(56) References Cited

U.S. PATENT DOCUMENTS 1,219,004 A 3/1917 Kalanquin
1,381,724 A 6/1921 Maloney
2,114,967 A 4/1938 Myers
2,438,543 A 3/1948 Custin et al.
2,563,018 A 8/1951 Fello
2,599,952 A 6/1952 Strayer
2,722,792 A 11/1955 Harrington
2,775,075 A 12/1956 McMaster et al.
2,819,568 A 1/1958 Kasick
(Continued)

FOREIGN PATENT DOCUMENTS

CA 1118514 2/1982
CA 1229985 12/1987
(Continued)

OTHER PUBLICATIONS

Brinksmeier et al., "Sensible Schleifwerkzeuge, Wie werkzeugseitige Piezosensorik bei der Werkzeug- und Prozessueberwachung hilft," Werkstatt Uno Betrieb, Hanser, Munchen, vol. 133(4), Apr. 1, 2000, XP000954470, ISSN: 0043-2792.
(Continued)

*Primary Examiner* — Jeffrey J Restifo
(74) *Attorney, Agent, or Firm* — Knobbe, Martens, Olson & Bear, LLP

(57) ABSTRACT

The present disclosure provides for a skate blade including a peripheral rim including a top surface and a bottom surface, the top surface configured to interface with a skate and the bottom surface configured to be in contact with a skating surface. The peripheral rim can include a first material, the peripheral rim defining one or more openings between the top surface and the bottom surface. The skate blade can further include one or more support ribs extending across the one or more openings of the peripheral rim.

18 Claims, 9 Drawing Sheets

(56) References Cited

U.S. PATENT DOCUMENTS 2,990,661 A 7/1961 Hackett
3,118,256 A 1/1964 Witt
3,259,959 A 7/1966 Tobey
3,524,285 A 8/1970 Rutt
3,574,975 A 4/1971 Liss
3,650,073 A 3/1972 Weisman
3,735,533 A 5/1973 Salberg
3,742,655 A 7/1973 Oliver
3,756,796 A 9/1973 Miller
3,789,551 A 2/1974 Norris et al.
3,800,632 A 4/1974 Juranitch
3,827,185 A 8/1974 Smith
3,839,828 A 10/1974 Arnold
3,881,280 A 5/1975 Thompson
3,948,001 A 4/1976 Miyazawa et al.
3,956,857 A 5/1976 Weisman
3,988,124 A 10/1976 Babcock
3,988,865 A 11/1976 Weisman
4,055,026 A 10/1977 Zwicker
4,078,337 A 3/1978 Chiasson et al.
4,094,101 A 6/1978 Robinson
4,109,419 A 8/1978 Broadbent
4,172,343 A 10/1979 Sakcriska
4,223,900 A * 9/1980 Olivieri ..... A63C 1/32 280/11.18
4,235,050 A 11/1980 Hannaford et al.
4,235,052 A 11/1980 Guidry
4,271,635 A 6/1981 Szalay
4,294,043 A 10/1981 Sakcriska
4,516,357 A 5/1985 Gach
4,534,134 A 8/1985 Consay et al.
4,549,372 A 10/1985 Sexton et al.
4,558,541 A 12/1985 Consay
4,570,387 A 2/1986 Unno et al.
4,615,144 A 10/1986 Peacock et al.
4,615,149 A 10/1986 Yoneda et al.
4,722,152 A 2/1988 Ek et al.
4,756,125 A 7/1988 Kadnar
4,967,515 A 11/1990 Tsujiuchi et al.
5,009,039 A 4/1991 Lager et al.
5,103,597 A * 4/1992 Courchesne ..... A63C 3/10 76/83
5,127,194 A 7/1992 Jobin
5,129,190 A 7/1992 Kovach et al.
5,139,138 A 8/1992 Isaksen
5,172,680 A 12/1992 Swan
5,177,901 A 1/1993 Smith
5,189,845 A 3/1993 Courchesne
5,195,277 A * 3/1993 Courchesne ..... B24D 15/066 76/83
5,259,148 A 11/1993 Wiand
5,484,148 A * 1/1996 Olivieri ..... A63C 1/30 280/11.18
5,547,416 A 8/1996 Timms
5,562,526 A 10/1996 Yoneda et al.
5,591,069 A 1/1997 Wurthman
5,601,473 A 2/1997 Strain et al.
5,823,854 A 10/1998 Chen
5,897,428 A 4/1999 Sakcriska
5,924,915 A 7/1999 Wachtler
5,989,114 A 11/1999 Donahue et al.
6,039,328 A * 3/2000 Pawlowski ..... A63C 17/18 280/11.18
6,105,975 A * 8/2000 Shum ..... A63C 1/32 280/11.12
6,116,989 A 9/2000 Balastik
6,422,934 B1 7/2002 Blach et al.
6,602,109 B1 8/2003 Malkin et al.
6,626,745 B1 9/2003 Bernard
6,761,363 B2 * 7/2004 Fask ..... A63C 1/32 280/11.18
6,851,680 B2 * 2/2005 Pham ..... A63C 1/00 280/11.18
6,932,361 B2 * 8/2005 Steinhauser, Jr. ..... A63C 1/00 280/11.18
7,018,280 B2 3/2006 Walker
7,104,876 B1 9/2006 Lin
7,118,466 B2 10/2006 Laney
7,121,932 B2 10/2006 Liao
7,220,161 B2 5/2007 Eriksson
7,387,562 B1 6/2008 Blum
7,473,164 B2 1/2009 Sunnen
7,758,053 B2 * 7/2010 Wylie ..... A63C 1/32 280/11.18
7,918,035 B1 * 4/2011 Jarczewski ..... A63C 3/10 280/809
7,934,978 B2 5/2011 Wilson et al.
8,197,304 B2 6/2012 Hummel
8,246,425 B2 8/2012 Schudel
8,277,284 B2 10/2012 Wilson et al.
8,316,742 B2 11/2012 Craig et al.
8,430,723 B2 4/2013 Moon
8,696,407 B2 4/2014 Dovel
8,801,501 B2 8/2014 Worthington
8,827,768 B2 9/2014 Allen
8,844,945 B2 * 9/2014 Koyess ..... A63C 1/32 280/11.18
8,888,567 B2 11/2014 Allen et al.
9,114,498 B1 8/2015 Layton, Jr. et al.
9,242,330 B1 1/2016 Layton, Jr. et al.
9,339,911 B2 5/2016 Eriksson
9,352,437 B2 5/2016 Layton, Jr. et al.
9,352,444 B2 5/2016 Layton, Jr. et al.
9,475,175 B2 10/2016 Layton, Jr. et al.
9,566,682 B2 2/2017 Layton, Jr. et al.
9,573,236 B2 2/2017 Layton, Jr. et al.
9,669,508 B2 6/2017 Layton, Jr. et al.
9,902,035 B2 2/2018 Layton, Jr. et al.
10,065,282 B2 9/2018 Layton, Jr. et al.
10,195,514 B2 * 2/2019 Davis ..... A63C 1/303
10,300,574 B2 5/2019 Layton, Jr. et al.
10,335,925 B2 * 7/2019 Layton, Jr. ..... B24B 41/06
D888,854 S * 6/2020 Chartrand ..... D21/757
10,974,123 B2 * 4/2021 Labonte ..... A63C 1/303
11,071,903 B2 7/2021 Labonte et al.
11,919,119 B2 3/2024 Layton, Jr. et al.
2002/0009964 A1 1/2002 Wolf et al.
2003/0156401 A1 8/2003 Komine et al.
2004/0209547 A1 10/2004 Hatano et al.
2005/0130571 A1 6/2005 Sunnen
2006/0040587 A1 2/2006 Eriksson
2006/0159533 A1 7/2006 Zeiler et al.
2006/0183411 A1 8/2006 Moon
2006/0223419 A1 10/2006 Moon
2007/0054598 A1 3/2007 Uchida et al.
2007/0184756 A1 8/2007 Dieck et al.
2008/0004743 A1 1/2008 Goers et al.
2008/0100008 A1 * 5/2008 Wan ..... A63C 1/30 280/11.18
2008/0176496 A1 7/2008 Tasi
2008/0280548 A1 11/2008 Wilson et al.
2009/0224494 A1 * 9/2009 Wan ..... A63C 1/32 280/11.18
2010/0068975 A1 3/2010 Yadid et al.
2010/0125362 A1 5/2010 Canora et al.
2011/0169233 A1 7/2011 Wilson et al.
2011/0201257 A1 8/2011 Walker
2012/0108151 A1 5/2012 Swist
2012/0190279 A1 7/2012 Ficai
2012/0302147 A1 11/2012 Trautner et al.
2013/0344774 A1 12/2013 Allen
2014/0087639 A1 3/2014 Worthington
2014/0179201 A1 6/2014 Proulx
2014/0213160 A1 7/2014 Page
2015/0061204 A1 3/2015 Talbot
2015/0140901 A1 5/2015 Eriksson
2015/0367224 A1 12/2015 Schatz
2017/0165808 A1 6/2017 Buser
2018/0126250 A1 5/2018 Proulx
2020/0376621 A1 12/2020 Dovel
2021/0069853 A1 3/2021 Berglund

(56) References Cited

U.S. PATENT DOCUMENTS

| | | | | |
|---|---|---|---|---|
| 2024/0066382 | A1* | 2/2024 | Spiegl | A63C 1/28 |
| 2024/0123320 | A1* | 4/2024 | Beaudet | A63C 1/32 |
| 2024/0335729 | A1* | 10/2024 | Signorell | A63C 1/303 |

FOREIGN PATENT DOCUMENTS

| | | | |
|---|---|---|---|
| CA | 2260531 | | 8/1999 |
| CA | 2309222 | | 11/2000 |
| CA | 2323321 | | 4/2002 |
| EP | 1604782 | A1 | 12/2005 |
| WO | WO 2016/065237 | A2 | 4/2016 |

OTHER PUBLICATIONS

"CAG One Service AB", downloaded from www.cagone.pl/dokumenty/cag-one-users-manual.pdf, 32 pages, Sep. 2009.

"ProSharp AS2001 Allpro, AS1001 Portable, Skatepal PRO3 Instructions", downloaded from www.prosharp.net/file/broschyroriginalinstructions-eng.pdf, 40 pages, Apr. 2013.

"Skatepal Pro Instructions", downloaded from www.prosharp.net/file/instruction-skatepal-pro2-eng.pdf, 12 pages, Oct. 2010.

"Spareparts Skatepal Pro 3", downloaded from www.prosharp.net/file/schematicssp13a1.pdf, 6 pages, Mar. 2013.

"SSM Catalog", downloaded from www.skyice.org/ssm_catalogue_2011.pdf, 12 pages.

CAG One Skate Sharpeners, "CAG One New Evolution Sharpening Machine", URL: http://cagone.com/evolution/, pp. 1-4.

Craig Forsythe, "CAG Speed III Sharpener Manual", Teflone Publications MMV, downloaded from www.cagone.com/img/speed.pdf, 14 pages, Aug. 2009.

ProSharp, "Grinding Wheels—SkatePals", 2015 ProSharp AB, URL: http://prosharp.com/products/grinding-wheels/grinding-wheels, pp. 1-9.

* cited by examiner

SKATE BLADE CLAMPING SYSTEMS

INCORPORATION BY REFERENCE TO ANY PRIORITY APPLICATIONS

Any and all applications for which a foreign or domestic priority claim is identified in the Application Data Sheet as filed with the present application are hereby incorporated by reference under 37 CFR 1.57.

This application claims the benefit of U.S. Provisional Patent Application No. 63/379,630, filed Oct. 14, 2022, the entire contents of which are hereby incorporated by reference in its entirety.

BACKGROUND

Field

The present disclosure relates to the field of skate blade manufacturing and skate blade clamping and alignment in skate sharpening systems.

Description of the Related Art

An ice skate may be designed with a removable blade in order to facilitate replacement. The removable portion of the blade may be constructed of multiple materials in order to have harder materials in contact with the ice surface, and to have stiff, lightweight materials in the upper portion to keep the overall weight of the assembly to a minimum. This weight savings may have distinct performance advantages in sporting activities such as hockey.

SUMMARY

The present disclosure relates to devices and methods which improve the current state of the art for clamping and aligning a skate blade with a skate sharpening system. The present disclosure also relates to devices and methods which reduce the overall weight of a skate blade.

In accordance with certain features, aspects, and advantages of at least one of the embodiments disclosed herein, a skate blade includes a peripheral rim including a top surface and a bottom surface, the top surface configured to interface with a skate and the bottom surface configured to be in contact with a skating surface, the peripheral rim including a first material, the peripheral rim defining one or more openings between the top surface and the bottom surface, and the skate blade further includes one or more support ribs extending across the one or more openings of the peripheral rim.

In accordance with certain features, aspects, and advantages of at least one of the embodiments disclosed herein, a skate blade includes a top portion including a first material; a bottom portion including a second material; a projection extending laterally from the top portion; and at least one clamping feature, the at least one clamping feature configured to interface with a clamping mechanism of a skate sharpening system.

In accordance with certain features, aspects, and advantages of at least one of the embodiments disclosed herein, a jaw member for a skate sharpening system includes a body portion; a first jaw face extending from the body portion; a second jaw face extending from the body portion; and one or more locating pins configured to removably coupled to the body portion.

BRIEF DESCRIPTION OF THE DRAWINGS

The foregoing aspects and many of the attendant advantages of this disclosure will become more readily appreciated as the same become better understood by reference to the following detailed description, when taken in conjunction with the accompanying drawings. The accompanying drawings, which are incorporated in, and constitute a part of, this specification, illustrate embodiments of the disclosure. Embodiment of the present disclosure are illustrated by way of example, and not by way of limitation, in the figures of the accompanying drawings and in which like references indicate similar elements. According to common practice, the various features of the drawings discussed below are not necessarily drawn to scale. The drawings are provided to illustrate example embodiments described herein and are not intended to limit the scope of the disclosure.

DETAILED DESCRIPTION OF SOME EMBODIMENTS

Various embodiments and aspects of the disclosures will be described with reference to details discussed below, and the accompanying drawings will illustrate the various embodiments. The following description and drawings are illustrative of the disclosure and are not to be construed as limiting the disclosure. Numerous specific details are described to provide a thorough understanding of various embodiments of the present disclosure. However, in certain instances, well-known or conventional details are not described in order to provide a concise discussion of embodiments of the present disclosures.

Reference in the specification to "one embodiment" or "an embodiment" or "another embodiment" means that a particular feature, structure, or characteristic described in conjunction with the embodiment can be included in at least one embodiment of the disclosure. The appearances of the phrase "in one embodiment" in various places in the specification do not necessarily all refer to the same embodiment.

Figure 1A:
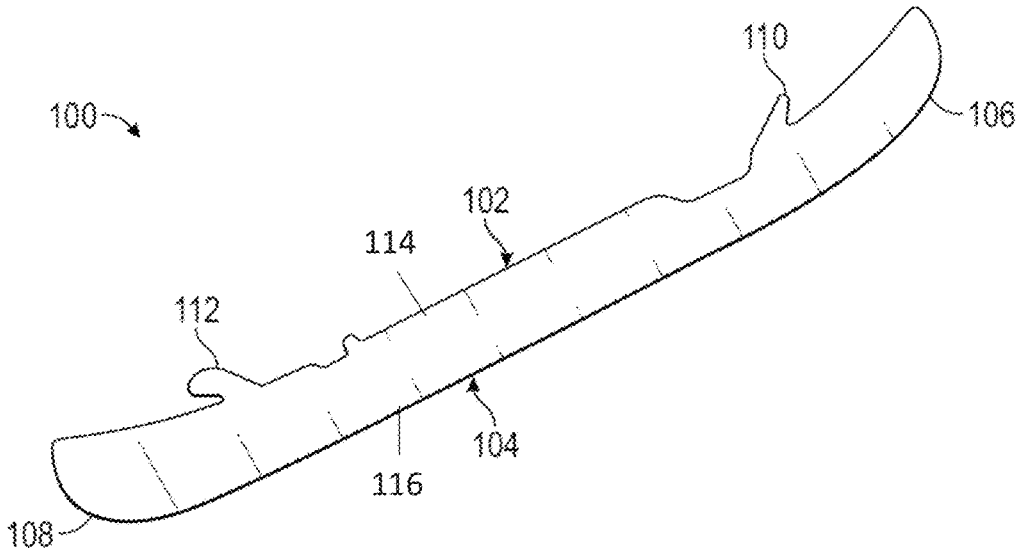
FIG. 1A illustrates an example schematic side profile of a skate blade.

FIG. 1A illustrates an example schematic side profile of the skate blade 100. The skate blade 100 includes a top portion 102, a bottom portion 104, a front portion/toe 106, a back portion/heel 108. The top portion 102 can include one or more anchors for coupling the skate blade 100 to a skate boot. For example, the top portion 102 can include a toe hook 110 and a heel hook 112. The toe hook 110 and the heel hook 112 are configured to be inserted into the toe and heel of the skate boot respectively. The top portion 102 can include a top edge 114. The bottom portion 104 can include an ice contacting surface 116. Generally, the skate blade 100 is removable from the skate boot. For example, the skate blade 100 may be removed from the skate boot prior to being sharpened. The skate blade 100 may also be sharpened while still inserted in the skate boot.

Figure 1B:
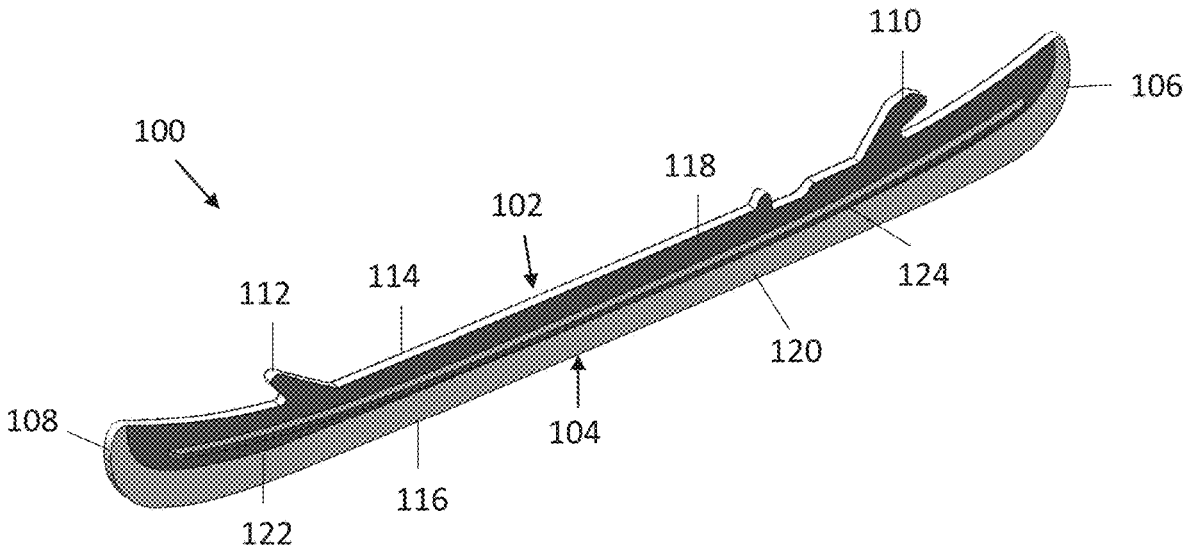
FIG. 1B illustrates a perspective view of a multi-material skate blade.

FIG. 1B illustrates a perspective view of the skate blade 100. In some cases, the skate blade 100 can be made of multiple materials, which can provide certain advantages such as reducing the weight of the skate blade 100. In the illustrated example, the skate blade 100 can include a first material 118 and a second material 120. The top portion 102 can be formed of the first material 118, and the bottom portion 104 can be formed of the second material 120. The first material 118 may be selected to be lightweight and/or stiff. For example, the first material 118 may be a molded plastic, composite, and/or the like. The second material 120 can be selected for interaction with the ice and may be a hard/dense material, such as stainless steel. A middle edge 122 can define the intersection between the first material 118 and the second material 120. In some cases, a portion of the second material 120 may extend into the first material 118 to allow first material 118 to be coupled to the second material 120. In some implementations, this portion may be a third material. The skate blade 100 can include a projection 124. The projection 124 can extend laterally outward from the first material 118. While only one projection 124 is shown, the opposite side of the skate blade 100 can include a projection 124 as well. The projection 124 can provide reinforcement for the first material 118 to stiffen the first material 118. In some cases, the projection 124 can provide other advantages such as structural advantages and/or can be configured to interface with other components.

Figure 1C:
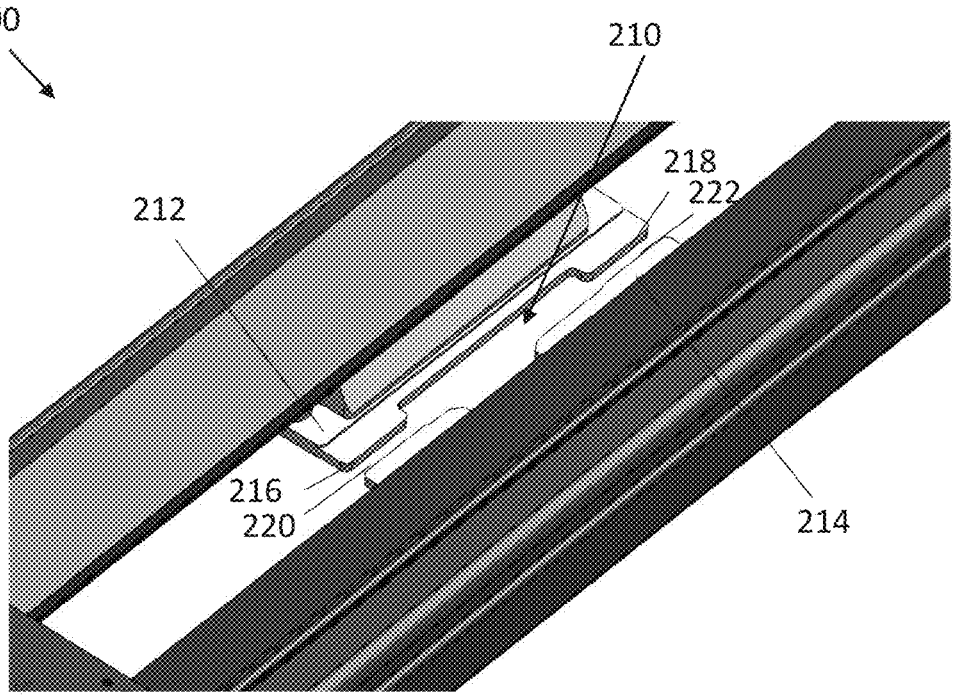
FIG. 1C illustrates a top perspective view of jaws of a skate sharpening system.

While constructing the skate blade 100 with different materials for the top portion 102 and the bottom portion 104 can provide advantages of weight reductions and/or improved stiffness (or rigidity), such construction may not be optimized for interactions with clamps included in skate sharpening system. "Skate sharpening systems," as the term is used herein includes systems for blade sharpening, blade profiling, blade contouring, blade surface checking (e.g., edge height checking), and/or the like. In skate sharpening systems, it may be desirable for the skate blade 100 to include flat, perpendicular shapes for precise references. For example, FIG. 1C illustrates a portion of a skate sharpening system 200 to secure the skate blade 100 during sharpening. The skate sharpening system 200 includes a jaw system 210. The jaw system 210 can include a first jaw member 212 and a second jaw member 214. Each jaw member 212, 214 can include jaw faces that are used to clamp the sides of skate blades to the skate sharpening system 200. For example, the first jaw member 212 includes a first jaw face 216 and a second jaw face 218. Similarly, the second jaw member 214 includes a third jaw face 220 and a fourth jaw face 222. As described herein, it may be advantageous to create specific features in the skate blade 100 in order to provide the most precise and repeatable clamping of the skate blade 100 in the skate sharpening system 200.

Figure 2:
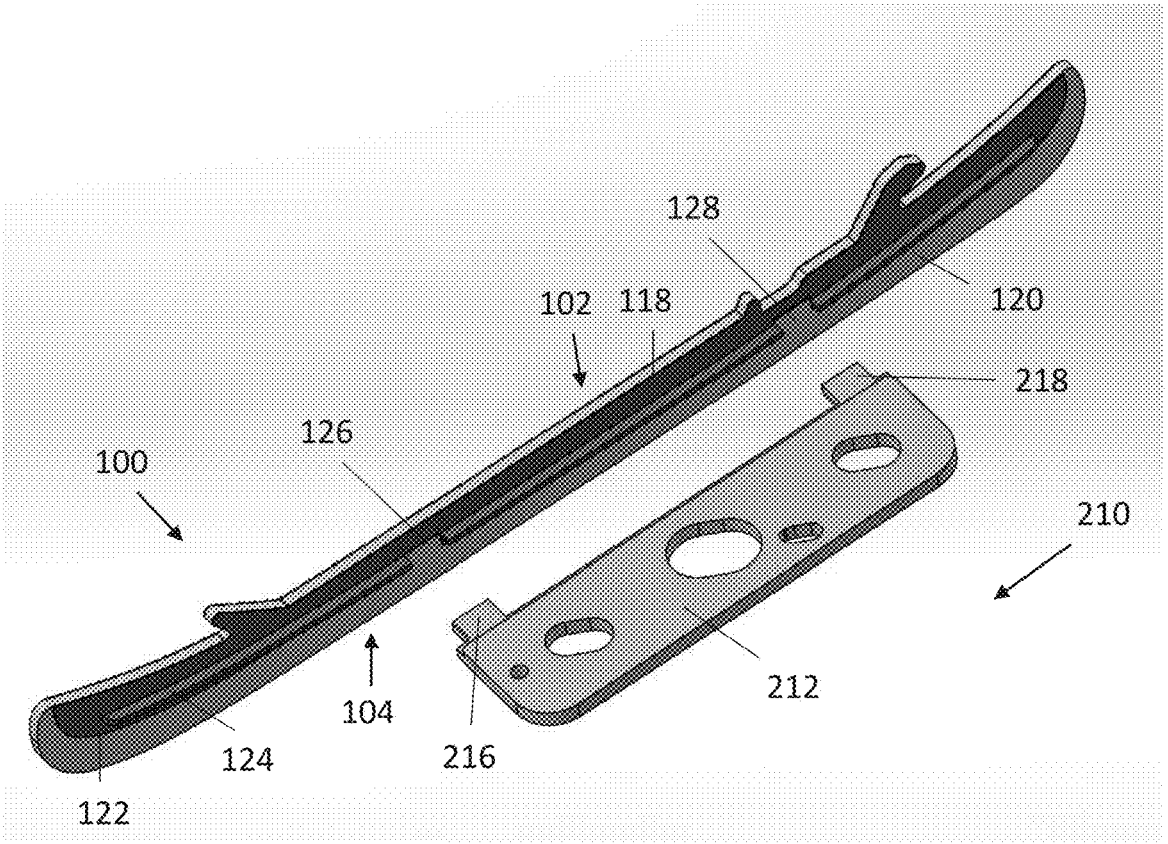
FIG. 2 illustrates the skate blade of FIG. 1B with clamping features for jaws of a sharpening system.

FIG. 2 illustrates an implementation of the skate blade 100 that includes a first example of clamping features for improved interaction with the jaw system 210 of the skate sharpening system 200. The skate blade 100 can include a first clamping feature 126 and a second clamping feature 128. The clamping features 126, 128 can be cutout portions of the skate blade 100. For example, the clamping features 126, 128 can be cutouts in the projection 124. The shape of the clamping features 126, 128 can be designed for the shape of the jaw faces 216, 218 of the jaw member 212 in the skate sharpening system 200. In the illustrated example, the jaw faces 216, 218 are rectangular. As such, the clamping features 126, 128 can likewise be rectangularly shaped. In other examples, the clamping features 126, 128 can be any other suitable shape, such as square, circular, oval, diamond, and/or the like. The size and distance between the first clamping feature 126 and the second clamping feature 128 can also be selected to align with the first jaw member 212. The clamping features 126, 128 can serve as a clearance area to allow the jaw faces 216, 218 to clamp solidly against a flat, perpendicular portion of the skate blade 100. The clamping features 126, 128 can also be at other non-perpendicular angles, as long as the angle is precise and predictable for the clamping system of the skate sharpener 200 to interface with. Additionally, the clamping features 126, 128 can serve as a locating feature for the first jaw member 212 such that the skate blade 100 sits in the correct location in the skate sharpening system 200 when the clamping features 126, 128 are aligned with the jaw faces 216, 218. In some implementations, the clamping features 126, 128 can be portions of the second material 120 that extend into the first material 118. This arrangement can provide a benefit of allowing the first jaw member 212 to contact the second material 120 instead of the first material 118. As illustrated the skate blade includes two clamping features. In other embodiments, the skate blade may include a single blade clamping feature (e.g., located in the center of the blade) or more three or more blade clamping features (e.g., spaced along the length of the blade).

Figure 3A:
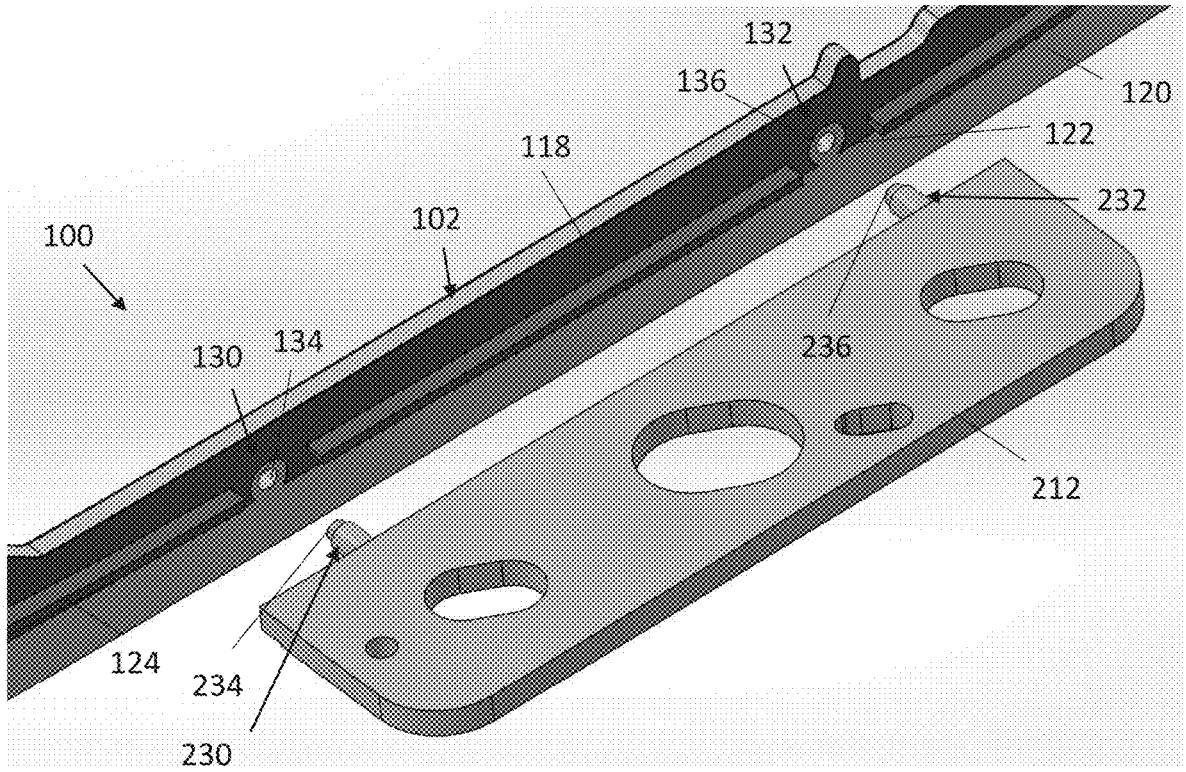
FIGS. 3A and 3B illustrate the skate blade of FIG. 1B including clamping features for jaws of a sharpening system.

FIG. 3A illustrates an implementation of the skate blade 100 that includes a second example of clamping features for improved interaction with the jaw system 210 of the skate sharpening system 200. In this example, the skate blade 100 can include a first clamping feature 130 and a second clamping feature 132. The clamping features 130, 132 can be cut out portions of the skate blade 100 and can be similar or identical to the clamping features 126, 128 except that the clamping features 130, 132 can include locating openings. For example, the first clamping feature 130 can include a first locating opening 134 and the second clamping feature can include a second locating opening 136. The locating openings 134, 136 can be openings extending through the skate blade 100. In some embodiments, the openings may extend partially through the skate blade. The locating openings 134, 136 can be any suitable shape such as square, circles, rectangles, ovals, and/or the like. For example, the locating opening may be a shaped opening that is shaped to orient the skate blade correctly within the skate sharpening systems. The locating openings 134, 136 can be configured to interact with locating pins of the first jaw member 212. For example, the first jaw member 212 can include a first locating pin 230 and a second locating pin 232. The first locating pin 230 can include a first locating projection 234. The second locating pin 232 can include a second locating projection 236. The locating projections 234, 236 can extend at least partially into the locating openings 134, 136 respectively when the skate blade 100 is inserted into the skate sharpening system 200. While not illustrated, the first jaw member 212 can include the jaw faces 216, 218, which can be positioned adjacent the locating pins 230, 232 in some implementations.

Figure 3B:
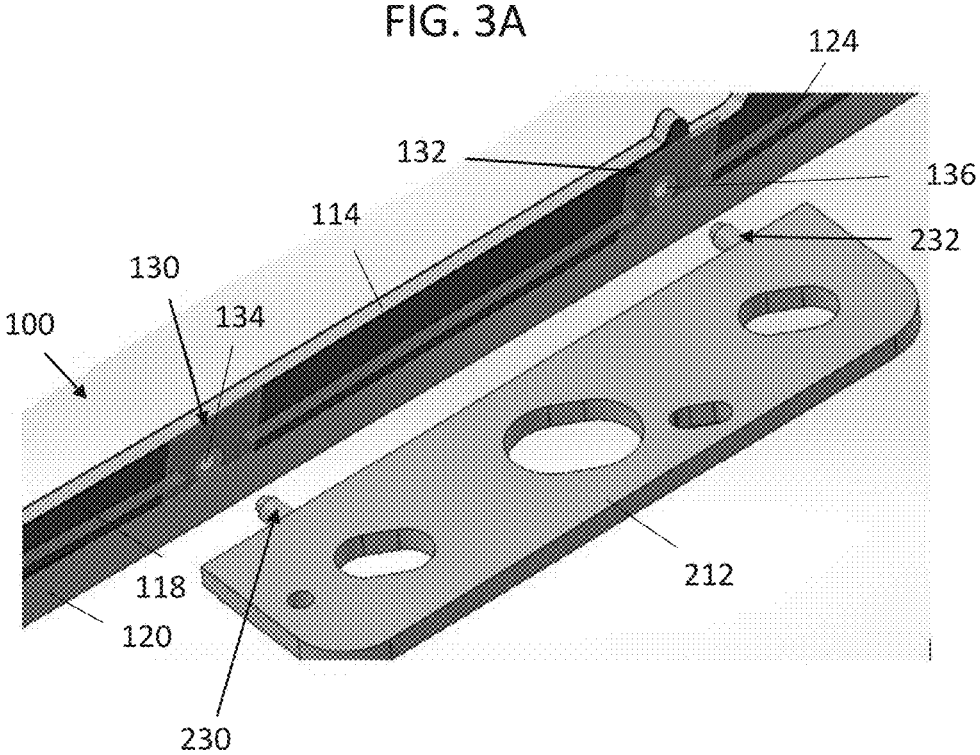

As shown in FIG. 3B, in some implementations, the clamping features 130, 132 can be extensions of the second material 120 that extend into the first material 118. In this implementation, the first jaw member 212 can directly contact the second material 120 instead of the first material 118. Additionally, the clamping features 130, 132 can provide additional reinforcement for the skate blade 100 when made of the second material 120. For example, because the projection 124 is removed in the area where the clamping features 130, 132 are located, having clamping features 130, 132 made of the second material 120 can compensate for the reduction in blade stiffness created by the removed portions of the projection 124. In some implementations, the clamping features 130, 132 may extend from the projection 124 to the top edge 114 of the skate blade 100. The clamping features can be reinforced portions or areas of the skate blade that are configured to interface with clamps and/or interfaces of the skate sharpening system. In some embodiments, the clamping features on a skate blade may be different. For example, a first clamping feature may be an opening having a first shape and a second clamping feature may be an opening of a second shape. The different clamping features can be configured such that the skate blade can only be oriented in a specific direction within the skate sharpening system.

Figure 4:
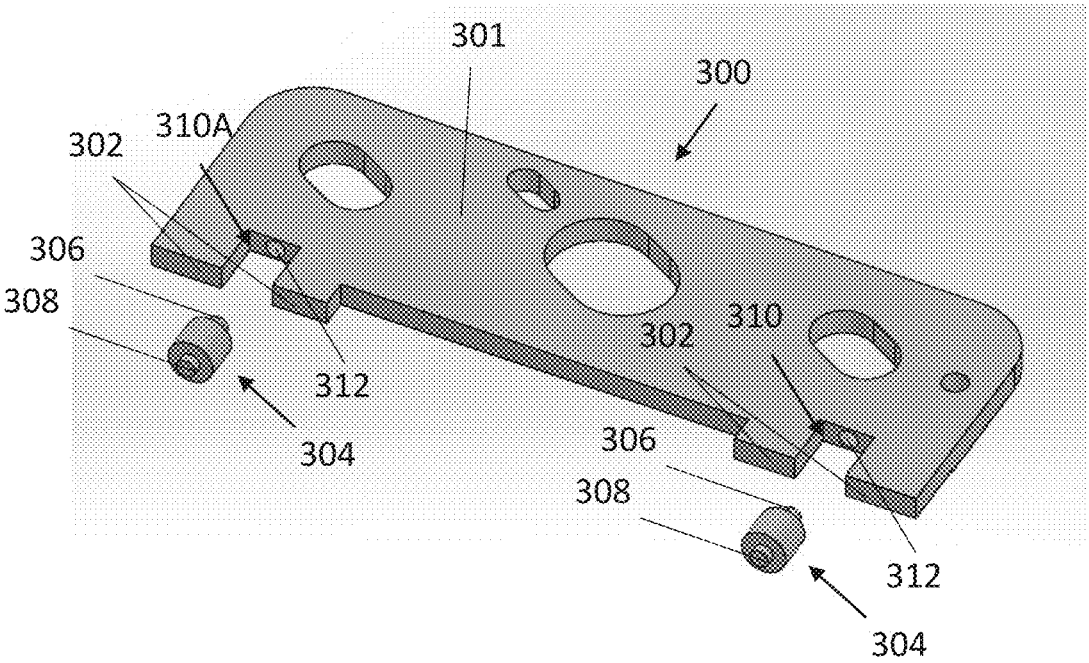
FIG. 4 illustrates an example jaw member of a skate sharpening system.

FIG. 4 illustrates an example jaw member 300 that can be used with the skate sharpening system 200 and the skate blade 100. The jaw member 300 can include a body portion 301, a first jaw face 302A and a second jaw face 302B. The jaw faces 302 are used to clamp the sides of the skate blades to the skate sharpening system 200. The first and second jaw faces 302 can be spaced apart on the jaw member 300. The jaw faces 302 can extend outwardly from the body portion 301. The jaw member 300 can include one or more removable locating pins 304. In the illustrated example, the jaw member 300 include a two locating pins, but additional pins could be used, as needed. The locating pins can be the same and can be interchangeable. The locating pins 304 can be configured to be removably coupled to the jaw member 300 and the skate blade 100 (e.g., via locating openings 134, 136 of the skate blade 100). The locating pin 304 can include a first projection 306 and a second projection 308. The first projection 306 can be opposite the second projection 308. In some cases, the first projection 306 can be identical to the second projection 308 such that the locating pin 304 is reversible. In use, the first projection 306 can be used to mount the first locating pin 304 to the jaw member 300. For example, the jaw face 302 can include a cutout 310 with a jaw locating opening 312. The cutout 310 can be configured to receive the first locating pin 304 into the first jaw face 302. The jaw locating opening 312 can allow the first locating pin 304 to be removably coupled to the jaw member 300 via the first projection 306. In some implementations, the first projection 306 and the jaw locating opening 312 can have a tight fit to prevent the locating pin 304 from being dislodged during use. In some implementations, the locating pins 304 can be magnetic and can be magnetically attached to the jaw member 300 and/or the skate blade 100. Having removable locating pins 304 can provide a benefit of allowing the jaw member 300, and the associated skate sharpening system 200, to be used with different types of skate blades. For example, the jaw member 300 can be used with skate blades that include locating openings 134 and skate blades that do not include locating openings 134.

Figure 5A:
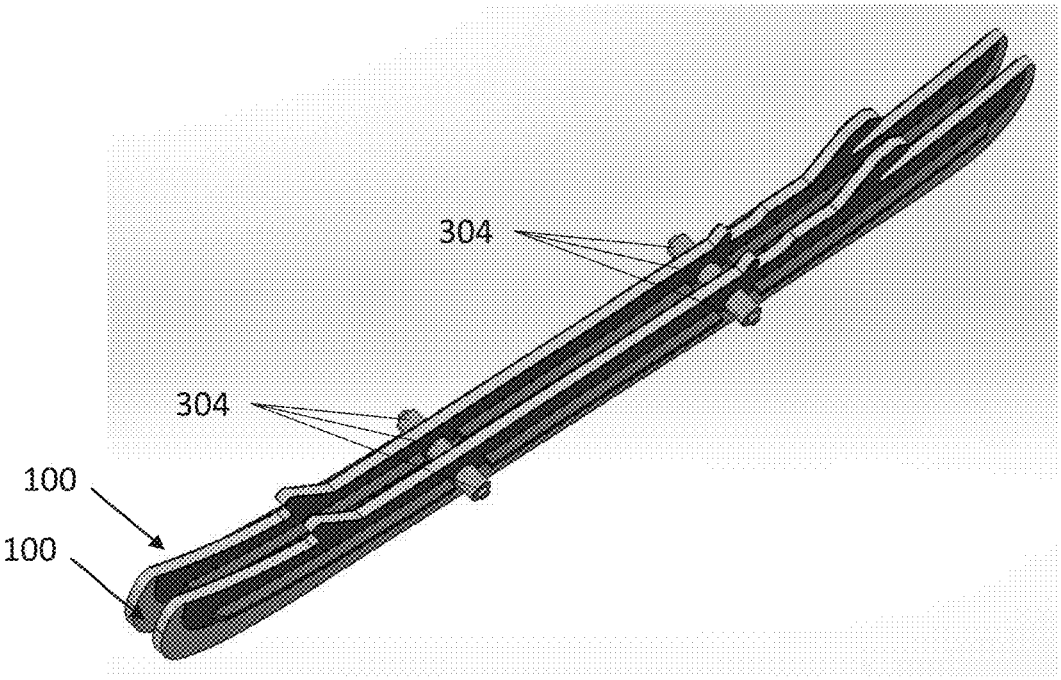
FIGS. 5A and 5B illustrate a perspective view and exploded view respectively stacked skate blades and locating pins.
Figure 5B:
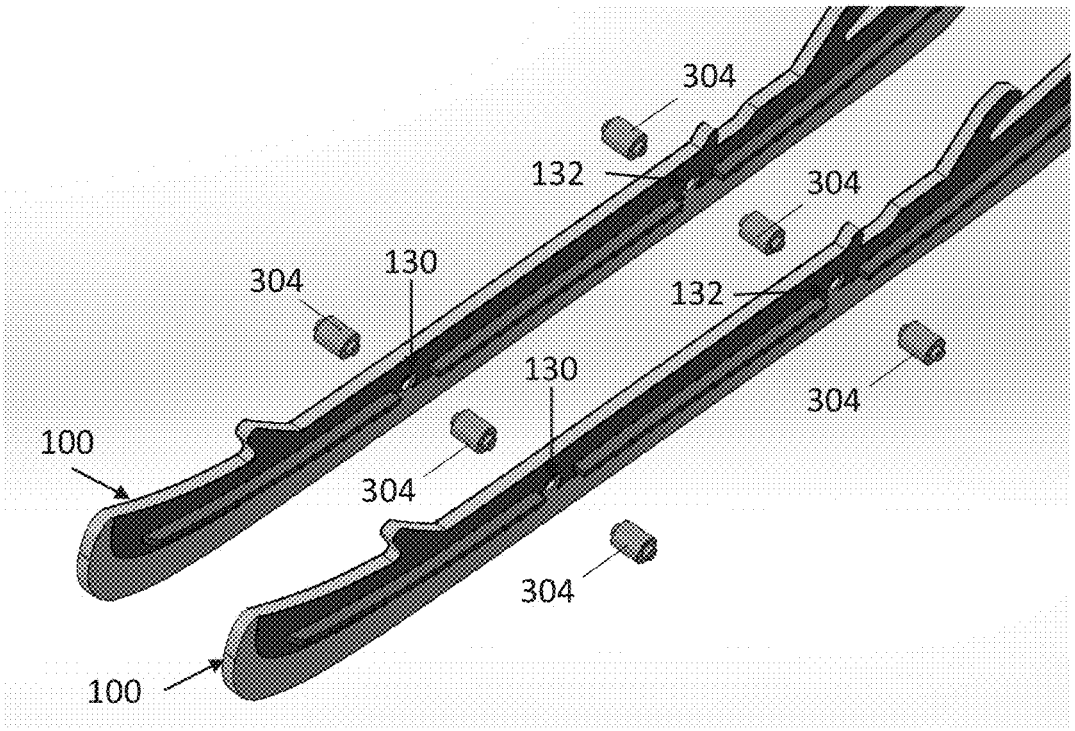

In some skate sharpening systems used for contouring blades (also referred to as profiling), it can be advantageous to stack multiple skate blades together and perform the contouring all at once. For example, 2, 3, 4, or more blades 100 may be contoured at the same time in the same skate sharpening system 200. Contouring multiple blades simultaneously can provide the advantages of a faster operation with less setup while ensuring that the contour applied to each blade is identical. In the case of removable blades with a multi-part structure, such as the skate blade 100 shown in at least FIG. 1B, the material added to the blade, such as the projection 124, may make it difficult or impossible to stack within the skate sharpening system 200. In this case, the locating pins 304 described above may be used to stack blades and maintain both parallel and aligned orientation between the blades. For example, FIGS. 5A and 5B illustrate a perspective view and exploded view respectively of stacked blades 100 including a plurality of locating pins 304 to both connect the skate blades 100 to each other and maintain proper spacing and alignment between the skate blades 100. This arrangement may also provide an advantage when used in a skate sharpening system 200 to sharpen multiple blades at once.

Figure 6A:
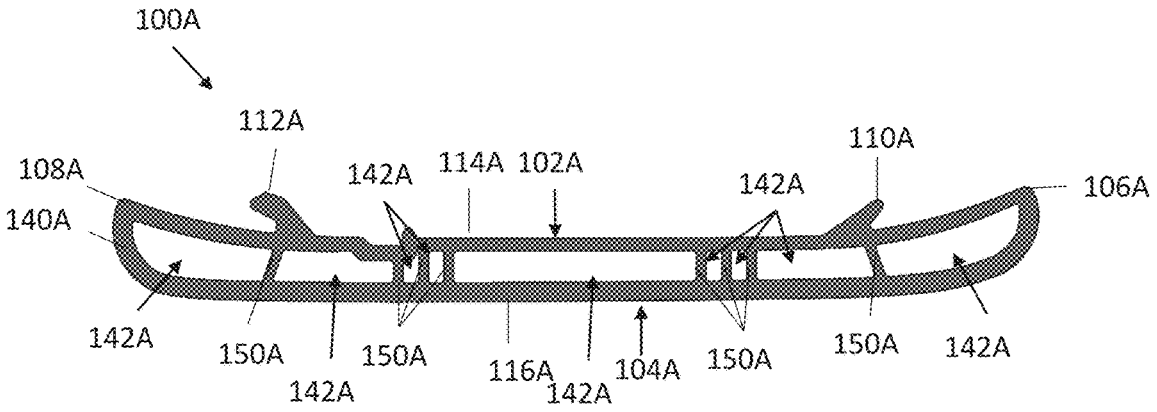
FIG. 6A illustrates an example implementation a lightweight skate blade.

FIG. 6A illustrates a side view of a skate blade 100A. The skate blade 100A may include some or all of the same components as skate blade 100 in at least FIG. 1A. Components of the skate blade 100A that share the same function and properties as the skate blade 100 are labeled with the same reference number but include an "A".

The skate blade 100A differs from the skate blade 100 in that some skate blade material 141A (e.g., stainless steel has been removed). The material is removed between the top edge 114A and the bottom surface 116A. When the material is removed, a peripheral rim 140A can remain, defining an outer periphery of the skate blade 100A. The rim 140A can extend from the top portion 102A to the bottom portion 104A, with a plurality of central openings 142A therebetween. Removing a portion of the skate blade material 141A can reduce the weight of the skate blade 100A for improved performance, while still allowing the skate blade 100A to undergo operations on the skate sharpening system 200. In some cases, the material can be removed using conventional machining techniques. The material can be removed in a selective manner such that a plurality of support elements 150A remain. The support elements 150A can extend between or through the openings 142A to contact the rim 140A at two locations. The support elements 150A can be ribs, as illustrated. The number of support elements 150A included in the skate blade 100A can vary, depending on the implementation. In the illustrated example, the skate blade 100A includes eight support elements 150A. In one example, one support element 150A can be positioned near or under the heel hook 112A and one support element 150A can be positioned near or under the toe hook 110A. In this example, six support elements 150A are positioned near the center of the skate blade 100A, with three support elements 150A positioned closer to the heel 108A and three support elements 150A positioned closer to the toe 106A. In some embodiments, the support elements can be combined into a one or more support elements. For example, the two groupings of three support elements 150A can each be combined into a wider single support element, resulting in only two support elements. In some embodiments, the skate blade may include a single support element. When used with the skate sharpening system 200, one or more of the support elements 150A can be used as a clamping surface for the jaw system 210. For example, the central support elements 150A may be positioned such that the first jaw face 216 engages the support elements 150A near the heel 108A and the second jaw face 218 engages the one support element 150A near the toe 106A or vice versa. The locations of the one support element 150A can also be selected to provide maximum structural support for the skate blade 100A. The support elements may include one or more clamping features that are configured to interface with the clamps on the skate sharpening system. In some implementations, the skate blade 100A can be between 20% and 80% lighter than conventional skate blade (e.g., between 20% and 80%, 30% and 70%, 40% and 60%, 45% and 55%, values between the foregoing, etc.).

Figure 6B:
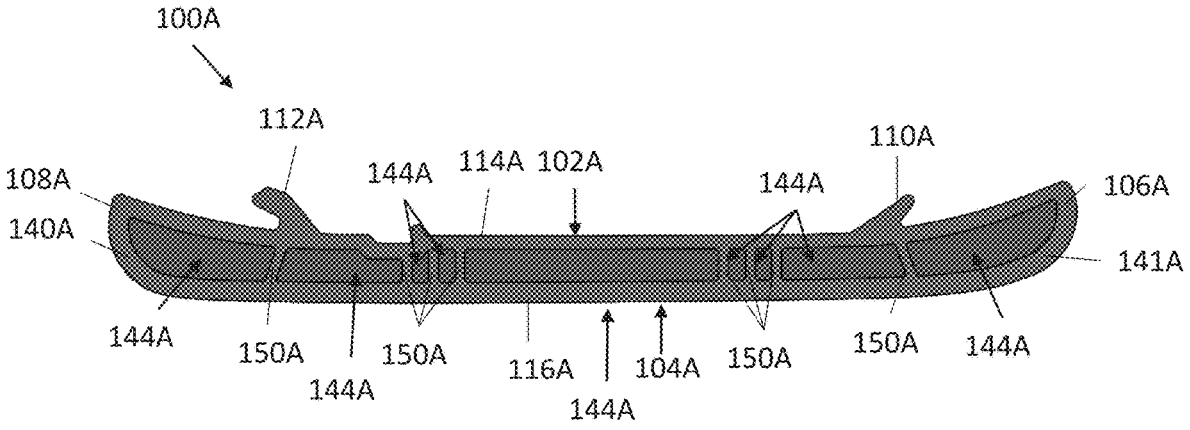
FIGS. 6B-6E illustrate various views of the skate blade of FIG. 6A.

With reference to FIGS. 6B-6E, in some implementations, the central openings 142A can be filled with a second material different than the skate blade material 141A. For example, a lower density material such as plastic, foam, carbon fiber, and/or the like can be used to fill the voids or central openings 142B in the skate blade 100A. As shown in FIG. 6B, each central opening 142A is filled with a second material 144A. In some implementations, replacing a portion of the skate blade material 141A with the second material 144A can reduce the weight of the skate blade 100A by 90% or more, depending on the filler material used for the second material 144A. An additional benefit of the second material 144A can be that snow or ice is prevented from becoming stuck in the central openings 142A during use of the skate blade 100A.

Figure 6C:
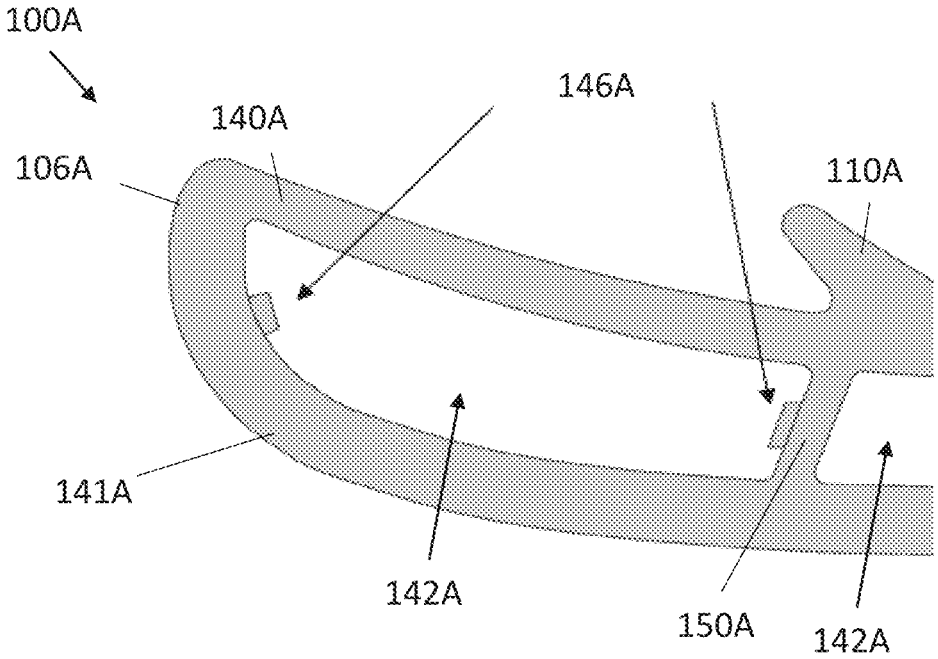
Figure 6D:
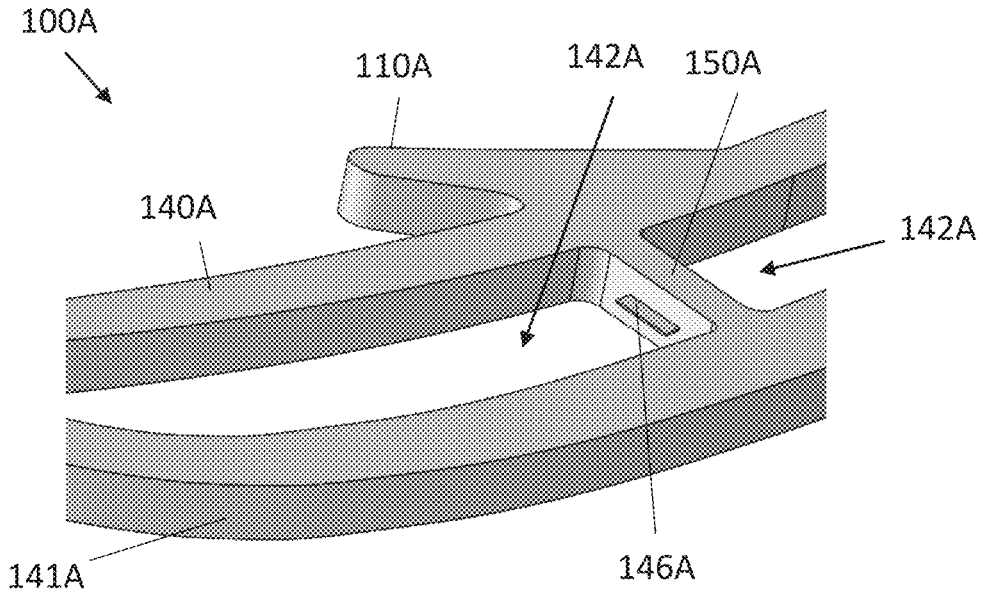

As shown in FIGS. 6C and 6D, in some implementations, the skate blade 100A can include one or more projections 146A. The projections 146A can extend from the rim 140A and/or the support elements 150A into the plurality of central openings 142A. The projections 146A can have a thickness less than the thickness of the skate blade 100A. The projections 146A can provide support for the second material 144A to couple the second material 144A to the skate blade 100A. Additionally, the projections 146A can help prevent the second material 144A from being dislodged due to stresses imparted on the skate blade 100A by the skater or external forces (e.g., hockey sticks, pucks, other skates, etc.). In some implementations, the projections 146A can be a continuous internal rim extending inwardly to the central openings 142A from the rim 140A and/or the support elements 150A. In some implementations, the projections 146A can be created by milling, drilling, and/or other means of material removal.

Figure 6E:
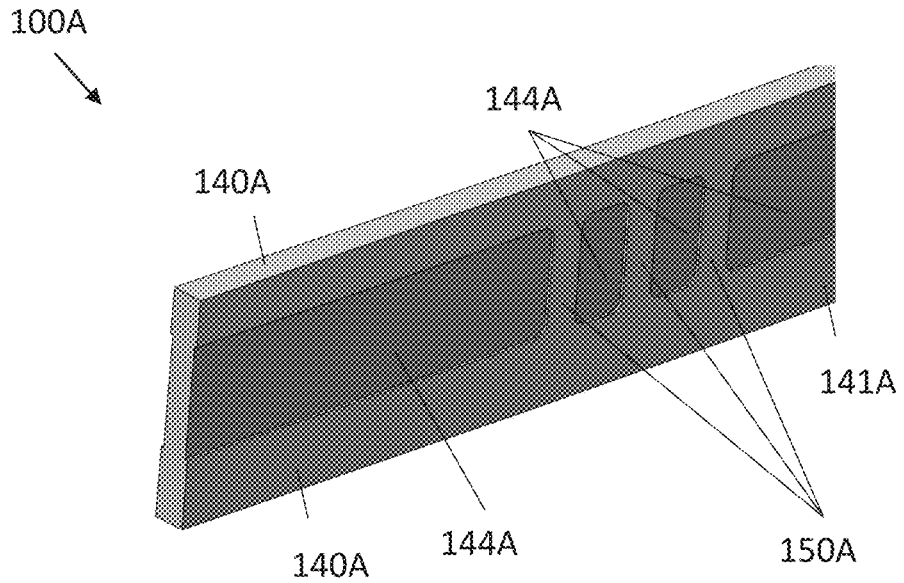
Figure 6F:
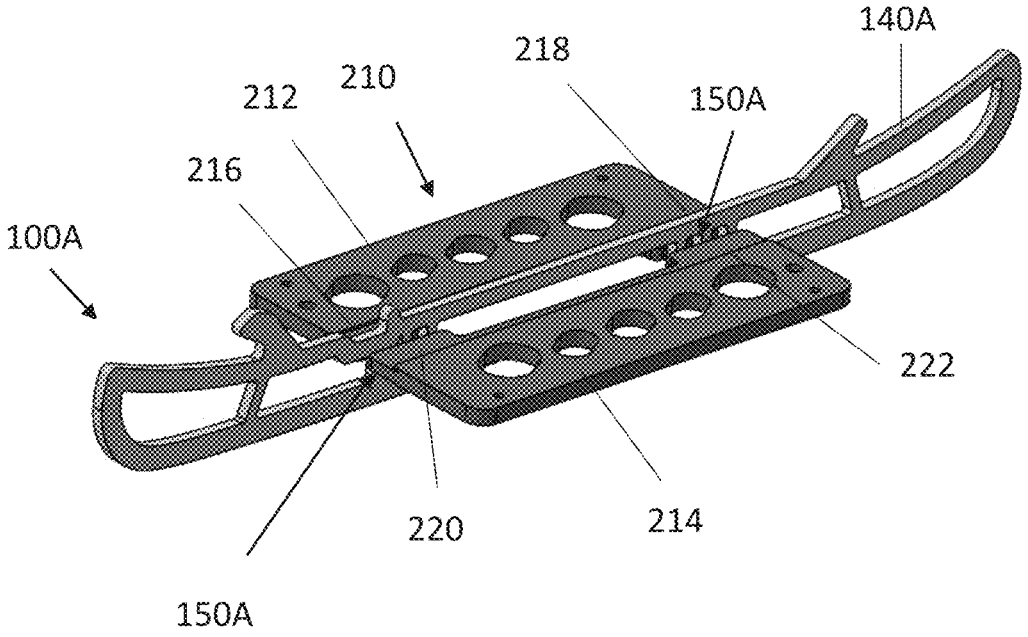
FIG. 6F illustrates a perspective view of the skate blade of FIG. 6A interacting with jaws of a skate sharpening system.

With reference to FIG. 6E, which shows a partial cross-sectional view of the skate blade 100A, in some implementations, the second material 144A can be added to the skate blade 100A such that the second material 144A is not flush with the blade material 141A. For example, the second material 144A can be inward of the blade material 141A. Having the second material 144A sub-flush to the blade material 141A can ensure that the jaw system 210 of the skate sharpening system 200 and/or other tools that rest on the blade material 141A during an operation instead of the second material 144A. For example, FIG. 6F illustrates the skate blade 100A engaged with the jaw system 210. As shown, the jaw faces 216, 218, 220, 222 contact the blade material 141A via the support elements 150A. If the second material 144A was not sub-flush, the skate sharpening system 200 may not be able to contact the skate blade 100A in a uniform manner and measurements taken of the skate blade 100A (e.g., an edge height readings) may be inaccurate.

Figure 6G:
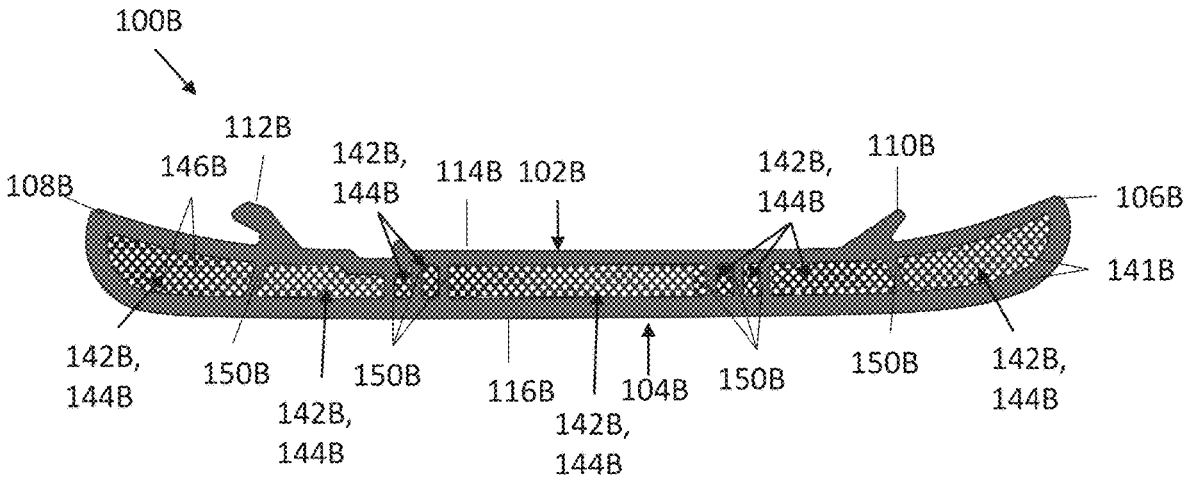
FIG. 6G illustrates an example implementation of a lightweight skate blade.

FIG. 6G illustrates an example implementation of a skate blade 100B. The skate blade 100B may include some or all of the same components as skate blade 100A in at least FIG. 6A. Components of the skate blade 100B that share the same function and properties as the skate blade 100 are labeled with the same reference number but include an "B".

The skate blade 100B can include a plurality of perforated sections 144B. The perforated sections 144B can be located at least in the central openings 142B. The perforated sections 144B can be portions of the skate blade 100B that include small openings 146B where material has been removed. Including perforated sections 144B can reduce the weight of the skate blade 100B compared to conventional skate blades, while allowing the skate blade 100B to retain its structure and strength provided by the blade material 141B.

Examples

Various example embodiments of the disclosure can be described by the following clauses:

Clause 1. A skate blade comprising: a peripheral rim comprising a top surface and a bottom surface, the top surface configured to interface with a skate and the bottom surface configured to be in contact with a skating surface, the peripheral rim comprising a first material, the peripheral rim defining one or more openings between the top surface and the bottom surface; and one or more support ribs extending across the one or more openings of the peripheral rim.

Clause 2. The skate blade of clause 1 further comprising a second material, the second material different from the first material, wherein the second material is positioned within the one or more openings and coupled to the peripheral rim and the one or more support ribs.

Clause 3. The skate blade of clause 2 further comprising a plurality of projections, the plurality of projections extending inwardly from at least one of the peripheral rim and the one or more support ribs into the one or more openings, wherein the plurality of projections are configured to extend into the second material.

Clause 4. The skate blade of clause 3, wherein the plurality of projections have a smaller diameter than the peripheral rim.

Clause 5. The skate blade of clause 2, wherein the second material comprises a plastic, a foam, or carbon fiber.

Clause 6. The skate blade of clause 2 further comprising an internal rim, the internal rim extending inwardly from at least one of the peripheral rim and the one or more support ribs into the one or more openings, wherein the internal rim is configured to extend into the second material.

Clause 7. The skate blade of clause 2, wherein the second material is not flush with the first material along a first side or a second side of the skate blade.

Clause 8. The skate blade of clause 1, wherein the one or more openings comprise perforated portions of the first material including a plurality of openings.

Clause 9. The skate blade of clause 1, wherein at least one of the one or more support ribs comprises a clamping surface for clamping to jaws of a skate sharpening machine.

Clause 10. The skate blade of clause 1, wherein the one or more support ribs comprise at least one clamping feature configured to interface with a clamping mechanism of a skate sharpening system.

Clause 11. A skate blade comprising: a top portion comprising a first material; a bottom portion comprising a second material; a projection extending laterally from the top portion; and at least one clamping feature, the at least one clamping feature configured to interface with a clamping mechanism of a skate sharpening system.

Clause 12. The skate blade of clause 11, wherein the at least one clamping feature comprises an opening in the projection having a defined shape.

Clause 13. The skate blade of clause 11, wherein the at least one clamping feature is a reinforced portion of the skate blade positioned within the top portion of the skate blade, wherein the reinforced portion comprises the second material that extends from the bottom portion into the top portion.

Clause 14. The skate blade of clause 11, wherein the at least one clamping feature includes a first clamping feature comprising a first locating opening and a second clamping feature comprising a second locating opening, the first locating opening and second locating opening configured to receive locating pins of the skate sharpening system.

Clause 15. The skate blade of clause 14, wherein the first clamping feature and the second clamping feature are orthogonal to a top surface of the skate blade.

Clause 16. The skate blade of clause 14, wherein the first locating opening and the second locating opening are different shaped openings.

Clause 17. The skate blade of clause 16, wherein the first locating opening and the second locating opening are configured such that the skate blade can only be positioned within the skate sharpening system in a defined orientation.

Clause 18. A jaw member for a skate sharpening system, the jaw member comprising: a body portion; a first jaw face extending from the body portion; a second jaw face extending from the body portion; and one or more locating pins configured to removably coupled to the body portion.

Clause 19. The jaw member of clause 18, wherein the first jaw face comprises a first cutout and the second jaw face comprises a second cutout, wherein a first locating pin of the one or more locating pins is configured to be positioned in the first cutout and a second locating pin of the one or more locating pins is configured to be positioned in the second cutout.

Clause 20. The jaw member of clause 18, wherein each locating pin of the one or more locating pins comprises a first projection and a second projection opposite the first projection, the first projection configured to be inserted into the body portion, the second projection configured to be inserted into a locating opening of a skate blade in use.

Clause 21. The jaw member of clause 18, wherein the one or more locating pins are magnetic.

Clause 22. The jaw member of clause 19, wherein the first cutout includes a first opening and the second cutout includes a second opening, the first opening and the second opening configured to receive projections of the one or more locating pins.

Conditional language used herein, such as, among others, "can," "could," "might," "may," "e.g.," and the like, unless specifically stated otherwise, or otherwise understood within the context as used, is generally intended to convey that certain embodiments include, while other embodiments do not include, certain features, elements and/or states. Thus, such conditional language is not generally intended to imply that features, elements and/or states are in any way required for one or more embodiments or that one or more embodiments necessarily include these features, elements and/or states.

Conjunctive language such as the phrase "at least one of X, Y, and Z," unless specifically stated otherwise, is otherwise understood with the context as used in general to convey that an item, term, etc. may be either X, Y, or Z. Thus, such conjunctive language is not generally intended to imply that certain embodiments require the presence of at least one of X, at least one of Y, and at least one of Z.

While the above detailed description may have shown, described, and pointed out novel features as applied to various embodiments, it may be understood that various omissions, substitutions, and/or changes in the form and details of any particular embodiment may be made without departing from the spirit of the disclosure. As may be recognized, certain embodiments may be embodied within a form that does not provide all of the features and benefits set forth herein, as some features may be used or practiced separately from others.

Additionally, features described in connection with one embodiment can be incorporated into another of the disclosed embodiments, even if not expressly discussed herein, and embodiments having the combination of features still fall within the scope of the disclosure. For example, features described above in connection with one embodiment can be used with a different embodiment described herein and the combination still fall within the scope of the disclosure.

It should be understood that various features and aspects of the disclosed embodiments can be combined with, or substituted for, one another in order to form varying modes of the embodiments of the disclosure. Thus, it is intended that the scope of the disclosure herein should not be limited by the particular embodiments described above. Accordingly, unless otherwise stated, or unless clearly incompatible, each embodiment of this disclosure may comprise, additional to its essential features described herein, one or more features as described herein from each other embodiment disclosed herein.

Features, materials, characteristics, or groups described in conjunction with a particular aspect, embodiment, or example are to be understood to be applicable to any other aspect, embodiment or example described in this section or elsewhere in this specification unless incompatible therewith. All of the features disclosed in this specification (including any accompanying claims, abstract and drawings), and/or all of the steps of any method or process so disclosed, may be combined in any combination, except combinations where at least some of such features and/or steps are mutually exclusive. The protection is not restricted to the details of any foregoing embodiments. The protection extends to any novel one, or any novel combination, of the features disclosed in this specification (including any accompanying claims, abstract and drawings), or to any novel one, or any novel combination, of the steps of any method or process so disclosed.

Furthermore, certain features that are described in this disclosure in the context of separate implementations can also be implemented in combination in a single implementation. Conversely, various features that are described in the context of a single implementation can also be implemented in multiple implementations separately or in any suitable subcombination. Moreover, although features may be described above as acting in certain combinations, one or more features from a claimed combination can, in some cases, be excised from the combination, and the combination may be claimed as a subcombination or variation of a subcombination.

Moreover, while operations may be depicted in the drawings or described in the specification in a particular order, such operations need not be performed in the particular order shown or in sequential order, or that all operations be performed, to achieve desirable results. Other operations that are not depicted or described can be incorporated in the example methods and processes. For example, one or more additional operations can be performed before, after, simultaneously, or between any of the described operations.

Further, the operations may be rearranged or reordered in other implementations. Those skilled in the art will appreciate that in some embodiments, the actual steps taken in the processes illustrated and/or disclosed may differ from those shown in the figures. Depending on the embodiment, certain of the steps described above may be removed, others may be added.

Furthermore, the features and attributes of the specific embodiments disclosed above may be combined in different ways to form additional embodiments, all of which fall within the scope of the present disclosure. Also, the separation of various system components in the implementations described above should not be understood as requiring such separation in all implementations, and it should be understood that the described components and systems can generally be integrated together in a single product or packaged into multiple products.

For purposes of this disclosure, certain aspects, advantages, and novel features are described herein. Not necessarily all such advantages may be achieved in accordance with any particular embodiment. Thus, for example, those skilled in the art will recognize that the disclosure may be embodied or carried out in a manner that achieves one advantage or a group of advantages as taught herein without necessarily achieving other advantages as may be taught or suggested herein.

Language of degree used herein, such as the terms "approximately," "about," "generally," and "substantially" as used herein represent a value, amount, or characteristic close to the stated value, amount, or characteristic that still performs a desired function or achieves a desired result. For example, the terms "approximately", "about", "generally," and "substantially" may refer to an amount that is within less than 10% of, within less than 5% of, within less than 1% of, within less than 0.1% of, and within less than 0.01% of the stated amount. As another example, in certain embodiments, the terms "generally parallel" and "substantially parallel" refer to a value, amount, or characteristic that departs from exactly parallel by less than or equal to 15 degrees, 10 degrees, 5 degrees, 3 degrees, 1 degree, 0.1 degree, or otherwise.

The scope of the present disclosure is not intended to be limited by the specific disclosures of preferred embodiments in this section or elsewhere in this specification and may be defined by claims as presented in this section or elsewhere in this specification or as presented in the future. The language of the claims is to be interpreted broadly based on the language employed in the claims and not limited to the examples described in the present specification or during the prosecution of the application, which examples are to be construed as non-exclusive.

Unless the context clearly requires otherwise, throughout the description and the claims, the words "comprise", "comprising", and the like, are to be construed in an inclusive sense as opposed to an exclusive or exhaustive sense, that is to say, in the sense of "including, but not limited to".

Reference to any prior art in this description is not, and should not be taken as, an acknowledgement or any form of suggestion that that prior art forms part of the common general knowledge in the field of endeavor in any country in the world.

The invention may also be said broadly to consist in the parts, elements and features referred to or indicated in the description of the application, individually or collectively, in any or all combinations of two or more of said parts, elements or features.

Where, in the foregoing description, reference has been made to integers or components having known equivalents thereof, those integers are herein incorporated as if individually set forth. In addition, where the term "substantially" or any of its variants have been used as a word of approximation adjacent to a numerical value or range, it is intended to provide sufficient flexibility in the adjacent numerical value or range that encompasses standard manufacturing tolerances and/or rounding to the next significant figure, whichever is greater.

It should be noted that various changes and modifications to the presently preferred embodiments described herein will be apparent to those skilled in the art. Such changes and modifications may be made without departing from the spirit and scope of the invention and without diminishing its attendant advantages. For instance, various components may be repositioned as desired. It is therefore intended that such changes and modifications be included within the scope of the invention. Moreover, not all of the features, aspects and advantages are necessarily required to practice the present invention. The following lists have example embodiments that are within the scope of this disclosure. The example embodiments that are listed should in no way be interpreted as limiting the scope of the embodiments. Various features of the example embodiments that are listed can be removed, added, or combined to form additional embodiments, which are part of this disclosure.

What is claimed is:

1. A skate blade comprising:

a peripheral rim comprising a top surface and a bottom surface, the top surface configured to interface with a skate and the bottom surface configured to be in contact with a skating surface, the peripheral rim defining one or more openings between the top surface and the bottom surface, wherein the top surface and the bottom surface is a first material; and one or more support ribs extending across the one or more openings of the peripheral rim.

2. The skate blade of claim 1, further comprising a second material, the second material different from the first material, wherein the second material is positioned within the one or more openings and coupled to the peripheral rim and the one or more support ribs.

3. The skate blade of claim 2, further comprising a plurality of projections, the plurality of projections extending inwardly from at least one of the peripheral rim and the one or more support ribs into the one or more openings, wherein the plurality of projections are configured to extend into the second material.

4. The skate blade of claim 3, wherein the plurality of projections have a smaller diameter than the peripheral rim.

5. The skate blade of claim 2, wherein the second material comprises a plastic, a foam, or carbon fiber.

6. The skate blade of claim 2, further comprising an internal rim, the internal rim extending inwardly from at least one of the peripheral rim and the one or more support ribs into the one or more openings, wherein the internal rim is configured to extend into the second material.

7. The skate blade of claim 2, wherein the second material is not flush with the first material along a first side or a second side of the skate blade.

8. The skate blade of claim 1, wherein the one or more openings comprise perforated portions of the first material including a plurality of openings.

9. The skate blade of claim 1, wherein at least one of the one or more support ribs comprises a clamping surface for clamping to jaws of a skate sharpening machine.

10. The skate blade of claim 1, wherein the one or more support ribs comprise at least one clamping feature configured to interface with a clamping mechanism of a skate sharpening system.

11. The skate blade of claim 1, wherein the one or more support ribs are the first material.

12. The skate blade of claim 1, wherein the one or more openings span a length of the skate blade.

13. A skate blade comprising:

a top portion comprising a first material;

a bottom portion comprising a second material;

a projection extending laterally from the top portion; and at least one clamping feature, the at least one clamping feature configured to interface with a clamping mechanism of a skate sharpening system, wherein the at least one clamping feature comprises one or more openings in the projection having a defined shape.

14. The skate blade of claim 13, wherein the at least one clamping feature further includes a reinforced portion of the skate blade positioned within the top portion of the skate blade, wherein the reinforced portion comprises the second material that extends from the bottom portion into the top portion.

15. The skate blade of claim 13, wherein the one or more openings comprise a first locating opening and a second locating opening, the first locating opening and the second locating opening configured to receive locating pins of the skate sharpening system.

16. The skate blade of claim 15, wherein the first locating opening and the second locating opening are orthogonal to a top surface of the skate blade.

17. The skate blade of claim 15, wherein the first locating opening and the second locating opening are different shaped openings.

18. The skate blade of claim 17, wherein the first locating opening and the second locating opening are configured such that the skate blade can only be positioned within the skate sharpening system in a defined orientation.

* * * * *